US007042323B2

(12) United States Patent
Joerg et al.

(10) Patent No.: US 7,042,323 B2
(45) Date of Patent: May 9, 2006

(54) SIGNAL TRANSFORMER AND METHOD FOR OPERATING SUCH A SIGNAL TRANSFORMER

(75) Inventors: Pieder Joerg, Domat/Ems (CH); Alper Akdag, Baden-Rütihof (CH)

(73) Assignee: ABB Research LTD, Zurich (CH)

( * ) Notice: Subject to any disclaimer, the term of this patent is extended or adjusted under 35 U.S.C. 154(b) by 245 days.

(21) Appl. No.: 10/645,607

(22) Filed: Aug. 22, 2003

(65) Prior Publication Data

US 2004/0036454 A1 Feb. 26, 2004

(30) Foreign Application Priority Data

Aug. 22, 2002 (EP) ..... 02405713

(51) Int. Cl.
*H01F 27/28* (2006.01)

(52) U.S. Cl. ..... 336/184; 336/180; 336/212

(58) Field of Classification Search ..... 336/212, 336/180, 5, 12, 150, 170, 181, 214, 200; 323/304–308

See application file for complete search history.

(56) References Cited

U.S. PATENT DOCUMENTS

| | | | | |
|---|---|---|---|---|
| 2,313,938 A | | 3/1943 | Hall, Jr. et al. | |
| 3,611,224 A | * | 10/1971 | Becker | 336/5 |
| 3,665,150 A | * | 5/1972 | Mejia | 219/130.1 |
| 3,990,030 A | * | 11/1976 | Chamberlin | 336/65 |
| 4,432,323 A | | 2/1984 | Iwasaki | |
| 4,766,365 A | * | 8/1988 | Bolduc et al. | 323/308 |
| 4,837,497 A | * | 6/1989 | Leibovich | 323/345 |
| 6,281,779 B1 | * | 8/2001 | Matsumoto et al. | 336/200 |
| 6,313,727 B1 | * | 11/2001 | Gabriel | 336/174 |
| 6,380,836 B1 | * | 4/2002 | Matsumoto et al. | 336/200 |
| 6,414,578 B1 | * | 7/2002 | Jitaru | 336/170 |
| 6,429,765 B1 | * | 8/2002 | Valdemarsson et al. | 336/212 |
| 6,741,155 B1 | * | 5/2004 | Usui | 336/200 |
| 2004/0032313 A1 | * | 2/2004 | Ferencz et al. | 336/200 |

FOREIGN PATENT DOCUMENTS

| | | |
|---|---|---|
| DE | 714453 | 11/1941 |
| DE | 89 15 612 | 10/1990 |
| EP | 1134756 | 9/2001 |
| GB | 2293933 | 4/1996 |

* cited by examiner

*Primary Examiner*—Anh Mai
(74) *Attorney, Agent, or Firm*—Buchanan Ingersoll PC

(57) ABSTRACT

A signal transformer having a primary limb and a first secondary limb is specified, a primary winding at least partly enclosing the primary limb and a secondary winding at least partly enclosing the first secondary limb and the primary limb being connected to the first secondary limb. Furthermore, 2n+1 additional secondary limbs are provided, where n=0, 1, 2, 3, . . . , and the additional secondary limbs are connected to the primary limb and the first secondary limb. At least one secondary winding is in each case provided for the additional secondary limbs and for the first secondary limb, the secondary winding at least partly enclosing the respective secondary limb. Moreover, a control winding is provided for each secondary limb, said control winding at least partly enclosing the respective secondary limb. Furthermore, a method for operating such a signal transformer and a driver circuit having such a signal transformer are specified.

23 Claims, 5 Drawing Sheets

SIGNAL TRANSFORMER AND METHOD FOR OPERATING SUCH A SIGNAL TRANSFORMER

FIELD OF THE INVENTION

The invention relates to the field of signal transformer technology. It is based on a signal transformer and a method for operating such a signal transformer in accordance with the preamble of claims 1 and 20.

BACKGROUND OF THE INVENTION

Signal transformers are nowadays used in a multiplicity of power electronic circuits, in particular in driver circuits for driving power semiconductor switches of converters. In this case, the signal transformer of the driver circuit serves for DC isolation of a signal function generator from the power semiconductor switch to be driven. Such a signal transformer is specified in GB 2 293 933 A, for example, wherein a first signal transformer is provided for DC-isolated transmission of a switch-on signal of the power semiconductor switch and a second signal transformer is provided for DC-isolated transmission of a switch-off signal of the power semiconductor switch. The two signal transformers are customarily embodied with two limbs in each case, the first limb being at least partly enclosed by a primary winding and the second limb being at least partially enclosed by a secondary winding. The two limbs of each such signal transformer are usually connected to one another in such a way that a magnetic circuit is produced, in which a main magnetic flux generated by the respective primary winding can flow.

What is problematic in the case of a signal transformer described above in accordance with GB 2 293 933 A is that this enables only a single primary winding signal present at the primary winding, for example a switch-on signal or a switch-off signal, to be transmitted as a secondary winding signal. However, if the intention is, for example, to provide two secondary winding signals, namely a switch-on signal and a switch-off signal, for example, as in the case of an abovementioned driver circuit for driving a power semiconductor switch, then a signal transformer with a respective signal function generator connected to the primary winding of the signal transformer has to be provided for each secondary winding signal. It is thus not possible to transmit a single primary winding signal on the transformer input side as a plurality of secondary winding signals on the transformer output side. By virtue of the fact that, therefore, only precisely one primary winding signal can be transmitted as a secondary winding signal in the case of a signal transformer described above in accordance with GB 2 293 933 A, when there are a plurality of secondary winding signals to be made available, as in the case of the driver circuit in accordance with GB 2 293 933 A, there is a huge increase in the material costs on account of the number of signal transformers required. A large number of signal transformers is additionally accompanied by an undesirably large space requirement. Furthermore, the availability of an abovementioned driver circuit decreases as the number of signal transformers rises, since the probability of faults increases with an increased number of signal transformers. Finally, this can result in long maintenance times associated with high maintenance costs which are unacceptable for an operator of, for example, a converter with driver circuits of this type.

SUMMARY OF THE INVENTION

Therefore, it is an object of the invention to specify a signal transformer in which a signal on the transformer input side can be transmitted as a plurality of output signals, which is furthermore particularly space-saving, is distinguished by a high availability and, moreover, is constructed simply, cost-effectively and in a readily maintainable fashion. Furthermore, the intention is to specify a method which enables particularly efficient operation of such a signal transformer. These objects are achieved by means of the features of claims 1 and 20. Advantageous developments of the invention are specified in the subclaims.

The signal transformer according to the invention has a primary limb and a first secondary limb, a primary winding being provided, which at least partly encloses the primary limb, and a secondary winding furthermore being provided, which at least partly encloses the first secondary limb. Moreover, the primary limb is connected to the first secondary limb. According to the invention, 2n+1 additional limbs are provided, where n=0, 1, 2, 3, . . . , and the additional secondary limbs are connected to the primary limb and the first secondary limb. At least one secondary winding is in each case provided for the additional secondary limbs and for the first secondary limb, the secondary winding at least partly enclosing the respective secondary limb. Furthermore, a control winding is provided for each secondary limb, said control winding at least partly enclosing the respective secondary limb. By virtue of the fact that 2n+1 additional secondary limbs, i.e. an odd number of additional secondary limbs, are provided and at least one secondary winding is in each case provided for the additional secondary limbs and for the first secondary limb, a primary winding signal fed into the primary winding can advantageously be transmitted to all the secondary windings so that a secondary winding signal is present at each output of the secondary windings. Transmission of a single primary winding signal as a plurality of secondary winding signals, i.e. as a number of secondary winding signals corresponding to the number of secondary windings, is thus made possible in a particularly simple manner. Accordingly, only a single signal transformer is required for transmitting a primary winding signal as a plurality of secondary winding signals, as a result of which a simple and cost-effective signal transformer requiring little space and materials can advantageously be achieved.

Moreover, by means of a control signal being fed into the control winding provided for each secondary limb, the secondary winding signal of the corresponding secondary limb can be switched on or off in a targeted manner, so that, by way of example, maintenance work can be carried out on this secondary limb without having to interrupt the operation of the signal transformer. As a result, it is advantageously possible to realize a signal transformer which is highly maintainable and characterized by a high availability.

In the invention's method for operating the signal transformer, a main flux is generated in the primary limb by feeding the primary winding signal into the primary winding. The main flux of the primary limb is furthermore divided into partial fluxes between the secondary limbs on both sides of the primary limb, the number of partial fluxes on one side of the primary limb corresponding to the number of secondary limbs on this side. Furthermore, according to the invention, the control signal is fed into at least one control winding in such a way that a control flux is generated in the associated secondary limb, the secondary winding signal present at the associated secondary winding of the corresponding secondary limb being influenced by means of the control flux. The influencing of the secondary winding signal is caused by the control flux, which influences, in particular reduces, compensates for or amplifies, the partial flux of the corresponding secondary limb. In the case of exemplary compensation of the partial flux by the generation of a control flux which counteracts the partial flux, no secondary winding signal is present at the associated secondary winding, so that said signal is switched off. The possibility of virtually arbitrary influencing of the corresponding secondary winding signal by the control flux enables the signal transformer to be operated particularly efficiently.

The signal transformer according to the invention is particularly advantageously employed in a driver circuit for at least one drivable power semiconductor switch. According to the invention, such a driver circuit has the signal transformer according to the invention, the driver circuit additionally comprising a signal function generator and the signal transformer according to the invention preferably being connected in between said signal function generator and the at least one drivable power semiconductor switch. Consequently, a multiplicity of the abovementioned drivable power semiconductor switches, which are advantageously in each case connected to a secondary winding of the signal transformer, can be driven by only a single signal transformer. Thus, the use of the signal transformer according to the invention in the driver circuit makes it possible to obtain a particularly space-saving, simple, cost-effective and readily maintainable driver circuit which is furthermore distinguished by a high availability.

This and further objects, advantages and features of the present invention will become apparent from the detailed description below of preferred embodiments of the invention in conjunction with the drawing.

Figure 1:
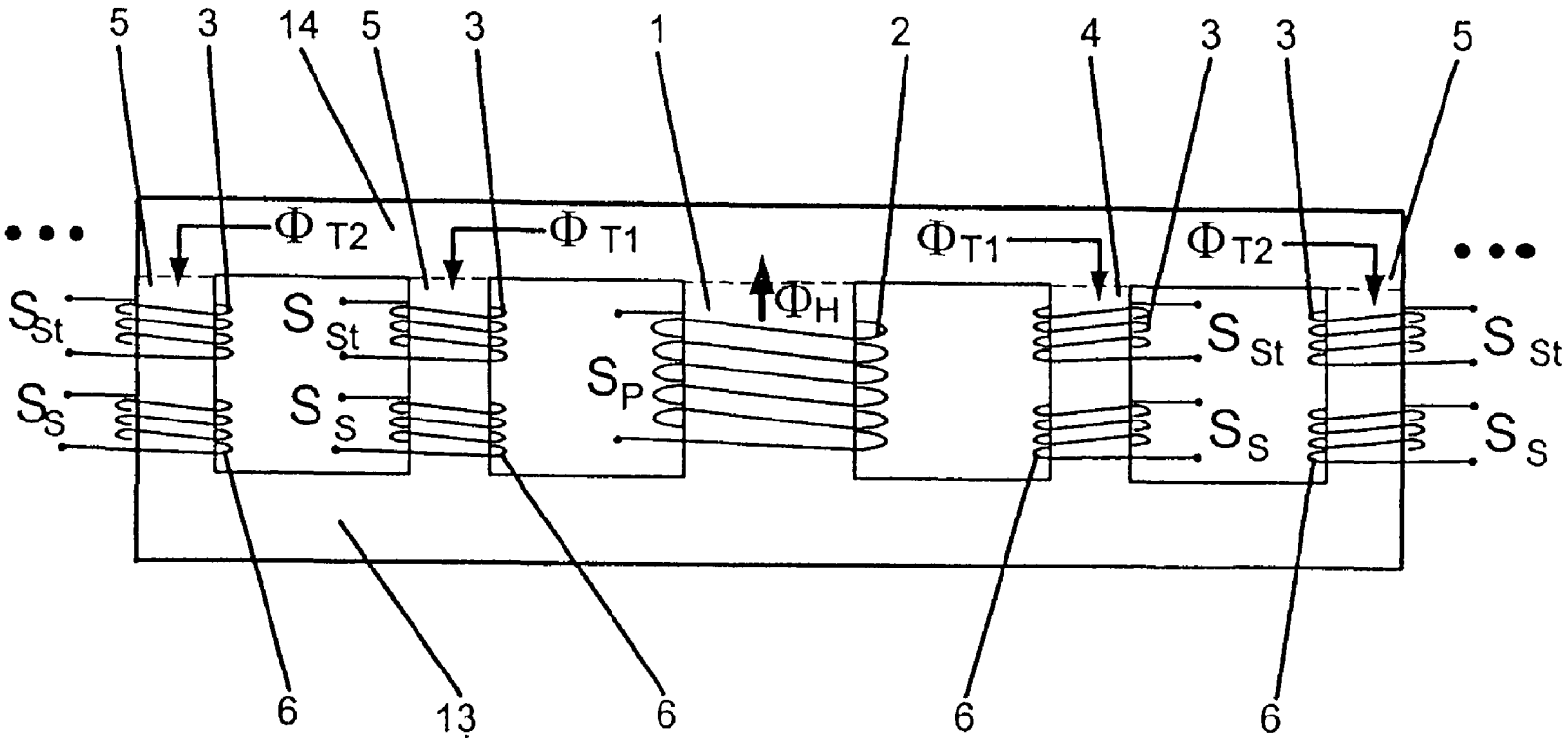
FIG. 1 shows an embodiment of a signal transformer according to the invention.

The reference symbols used in the drawing and their meanings are summarized in the List of designations. In principle, identical parts are provided with identical reference symbols in the figures. The embodiment described is an example of the subject matter of the invention and has no restrictive effect.

DETAILED DESCRIPTION OF THE INVENTION

FIG. 1 illustrates an embodiment of a signal transformer according to the invention. The signal transformer according to the invention has therein a primary limb 1 and a first secondary limb 4. Furthermore, a primary winding 2 is provided, which at least partly encloses the primary limb 1. Furthermore, in accordance with FIG. 1, a secondary winding 6 is provided, which at least partly encloses the first secondary limb 4. Moreover, the primary limb 1 is connected to the first secondary limb 4. According to the invention, an odd number of, i.e. 2n+1 additional secondary limbs 5 are provided, where n=0, 1, 2, 3, . . . . Accordingly, the signal transformer according to the invention has an even number of secondary limbs 4, 5 overall. In accordance with FIG. 1, the additional secondary limbs 5 are connected to the primary limb 1 and the first secondary limb 4. At least one secondary winding 6 is in each case provided for the additional secondary limbs 5 and for the first secondary limb 4, the secondary winding 6 at least partly enclosing the respective secondary limb 4, 5. The primary limb 1 and the secondary limb 4, 5 are preferably constructed from a magnetizable material. With the primary limb 1 and the first secondary limb 4, the additional secondary limbs 5 preferably form an essentially comb-shaped signal transformer core 13 embodied in one piece. By means of this, the abovementioned connection of the additional secondary limbs 5 to the primary limb 1 and the first secondary limb 4 is formed via the signal transformer core 13 formed in one piece, on the one hand, and via a yoke 14, on the other hand, the yoke 14 being connected to the open side of the signal transformer core 13, thereby closing a magnetic circuit between yoke 14 and signal transformer core 13. Furthermore, a control winding 3 is provided for each secondary limb 4, 5, said control winding likewise at least partly enclosing the respective secondary limb 4, 5. By means of the 2n+1 additional secondary limbs 5 and by means of the in each case at least one secondary winding 6 provided for the additional secondary limbs 5 and for the first secondary limb 4, a primary winding signal $S_p$ fed into the primary winding 1 can advantageously be transmitted to all the secondary windings 6. A secondary winding signal $S_s$ is thus present at each output of the secondary winding 6. Transmission of a single primary winding signal $S_p$ as a plurality of secondary winding signals $S_s$ corresponding to the number of secondary windings 6 is thus advantageously possible, as a result of which a large saving of space and materials can be achieved by obviating the multitransformer solution known from the prior art.

By feeding a control signal $S_{st}$ into the control winding 3 provided for each secondary limb 6 in accordance with FIG. 1, it is possible, moreover, for the secondary winding signal $S_s$ of the corresponding secondary limb 6 to be switched on or off in a targeted manner, so that, by way of example, maintenance work can be carried out on said secondary limb 4, 5 without having to interrupt the operation of the signal transformer. The signal transformer according to the invention thus represents a highly maintainable solution with a high availability. In FIG. 1, by way of example and for the sake of clarity, only one secondary winding 6 is illustrated for each secondary limb 4, 5, an arbitrary number of secondary windings 6 for each secondary limb 4, 5 being conceivable. With a plurality of secondary windings 6 for each secondary limb 4, 5, the number of secondary winding signals $S_s$ per secondary limb 4, 5 can advantageously be increased, it being possible for the secondary winding signals $S_s$ to be switched on or off in a targeted manner by means of the abovementioned control signal $S_{St}$ for such a secondary limb 4, 5. The influencing of the secondary winding signal $S_s$ will be discussed in greater detail in the description of the invention's method for operating the signal transformer.

In accordance with FIG. 1, in the signal transformer according to the invention, there is the same number of secondary limbs 4, 5 on both sides of the primary limb 1, i.e. a first secondary limb 4 and three additional secondary limbs 5 are shown in the signal transformer shown by way of example in FIG. 1, the first secondary limb 4 and one additional secondary limb 5 of the total of three additional secondary limbs 5 being arranged on one side of the primary limb 1 and the other additional secondary limbs 5 of the total of three additional secondary limbs 5 being arranged on the other side of the primary limb 1. As a result, with regard to the direction of extent of all the limbs 1, 4, 5, a signal transformer is achieved having an advantageous small structural height and a further reduced spatial requirement resulting from this.

In accordance with FIG. 1, the distance between respectively adjacent secondary limbs 4, 5 and the distance between the primary limb 1 and a respective secondary limb 4, 5 adjacent to the primary limb 1 are the same. Together with the even number of secondary limbs 4, 5 which, as described above, are arranged in the same number on both sides of the primary limb 1, a construction of the signal transformer which is symmetrical with respect to the primary limb 1 can thus be achieved and the signal transformer can be produced easily as a result. Furthermore, a main flux $\Phi_H$ generated in the primary limb 1 as a result of a primary winding signal $S_p$ being fed into the primary winding 2 is divided into partial fluxes $\Phi_{T1}$, $\Phi_{T2}$, $\Phi_{T3}$, . . . between the secondary limbs 4, 5 on both sides of the primary limb 1, the number of partial fluxes $\Phi_{T1}$, $\Phi_{T2}$, $\Phi_{T3}$, . . . on one side of the primary limb corresponding to the number of secondary limbs 4, 5 on this side.

Figure 2:
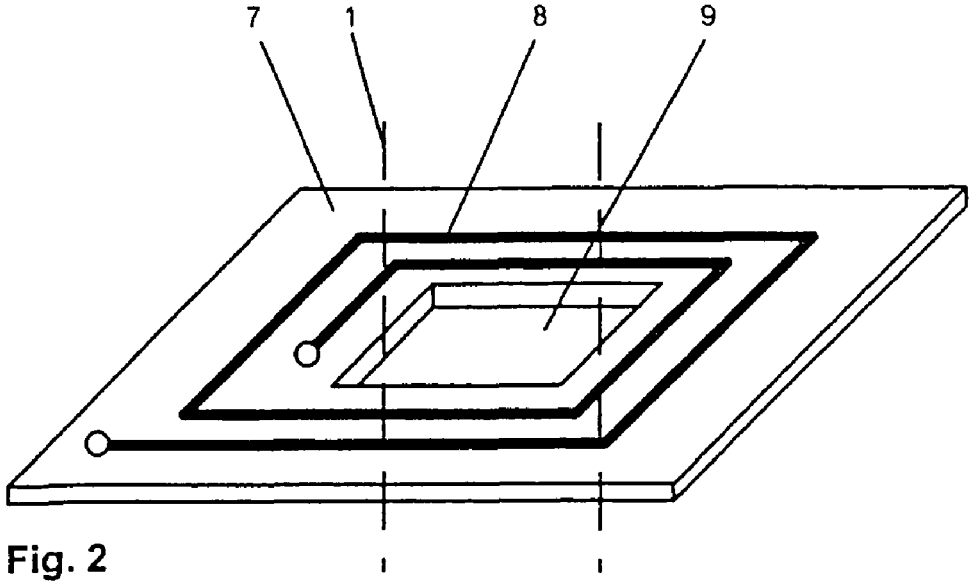
FIG. 2 shows an embodiment of a primary winding of the signal transformer according to the invention.

The above-described primary winding 2, secondary windings 6 and control windings 3 are in each case realized as wound conductors in accordance with FIG. 1. In a preferred embodiment of a primary winding 2 of the signal transformer according to the invention as shown in FIG. 2, the primary winding 2 is designed as a conductor track 8 of a primary winding printed circuit board 7. As a result, it is advantageously possible to save material and thus weight. Furthermore, the conductor track 8 of the primary winding printed circuit board 7 is surrounded by an insulating layer which, for the sake of clarity, is not illustrated in FIG. 2 and which advantageously protects the conductor track 8 from partial discharges and corrosion. Furthermore, the primary winding printed circuit board 7 in accordance with FIG. 2 has an opening 9 for leading through the primary limb 1. The conductor track 8 of the primary winding printed circuit board 7 furthermore extends around the opening 9 in the board propagation direction of the primary winding printed circuit board 7. As a result, it is possible to achieve a low-inductance primary winding 2 with a small structural height. The structural height of the signal transformer according to the invention itself can advantageously be reduced with the use of the primary winding printed circuit board 7 described above, in particular with only one or a small number of secondary windings 6, realized as wound conductors, per secondary limb 4, 5.

Figure 3:
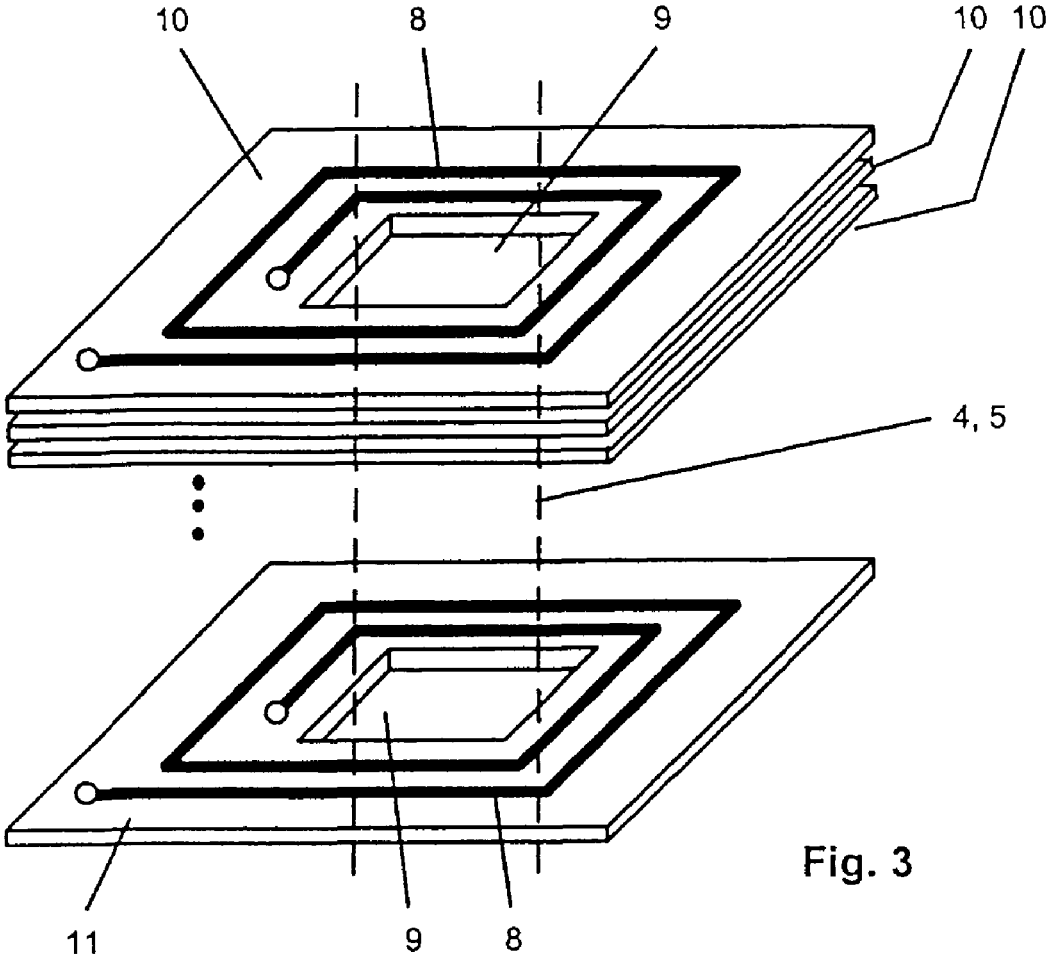
FIG. 3 shows a first embodiment of a secondary winding and a control winding of the signal transformer according to the invention.

In a preferred first embodiment of the secondary winding 6, in particular for more than one secondary winding 6 per secondary limb 4, 5, and of the control winding 3 of the signal transformer according to the invention as shown in FIG. 3, the or each secondary winding 6 of a secondary limb 4, 5 is in each designed as a conductor track 8 of a secondary winding printed circuit board 10, the control winding 3 of a secondary limb 4, 5 furthermore being designed as a conductor track 8 of a control winding printed circuit board 11. As a result, it is advantageously possible to save material and thus weight of the secondary winding 6 and of the control winding 3. Furthermore, the conductor track 8 of the secondary winding printed circuit board 10 and the conductor track 8 of the control winding printed circuit board 11 are in each case surrounded by an insulating layer which, for the sake of clarity, is not illustrated in FIG. 3 and which advantageously protects the conductor track 8 from partial discharges and corrosion. Furthermore, the secondary winding printed circuit board 10 and the control winding printed circuit board 11 in accordance with FIG. 3 each have an opening 9 for leading through the respective secondary limb 4, 5. In accordance with FIG. 3, the conductor track 8 of the secondary winding printed circuit board 10 extends around the opening 9 in the board propagation direction of the secondary winding printed circuit board 10. Furthermore, the conductor track 8 of the control winding printed circuit board 11 extends around the opening 9 in the board propagation direction of the control winding printed circuit board 11. As a result, it is possible to achieve a low-inductance secondary winding 6 and control winding 3 with a small structural height. The structural height of the signal transformer according to the invention itself can advantageously be reduced with the use of the above-described secondary winding printed circuit board 10 and the above-described control winding printed circuit board 11, in particular also with a primary winding 2 realized as a wound conductor. A further advantageous reduction of the structural height of the signal transformer according to the invention can be achieved by employing a primary winding printed circuit board in accordance with FIG. 2 in the signal transformer according to the invention in relation to the secondary winding printed circuit board or boards 10 per secondary limb 4, 5 and the associated control winding printed circuit board 11 in accordance with FIG. 3.

Figure 4:
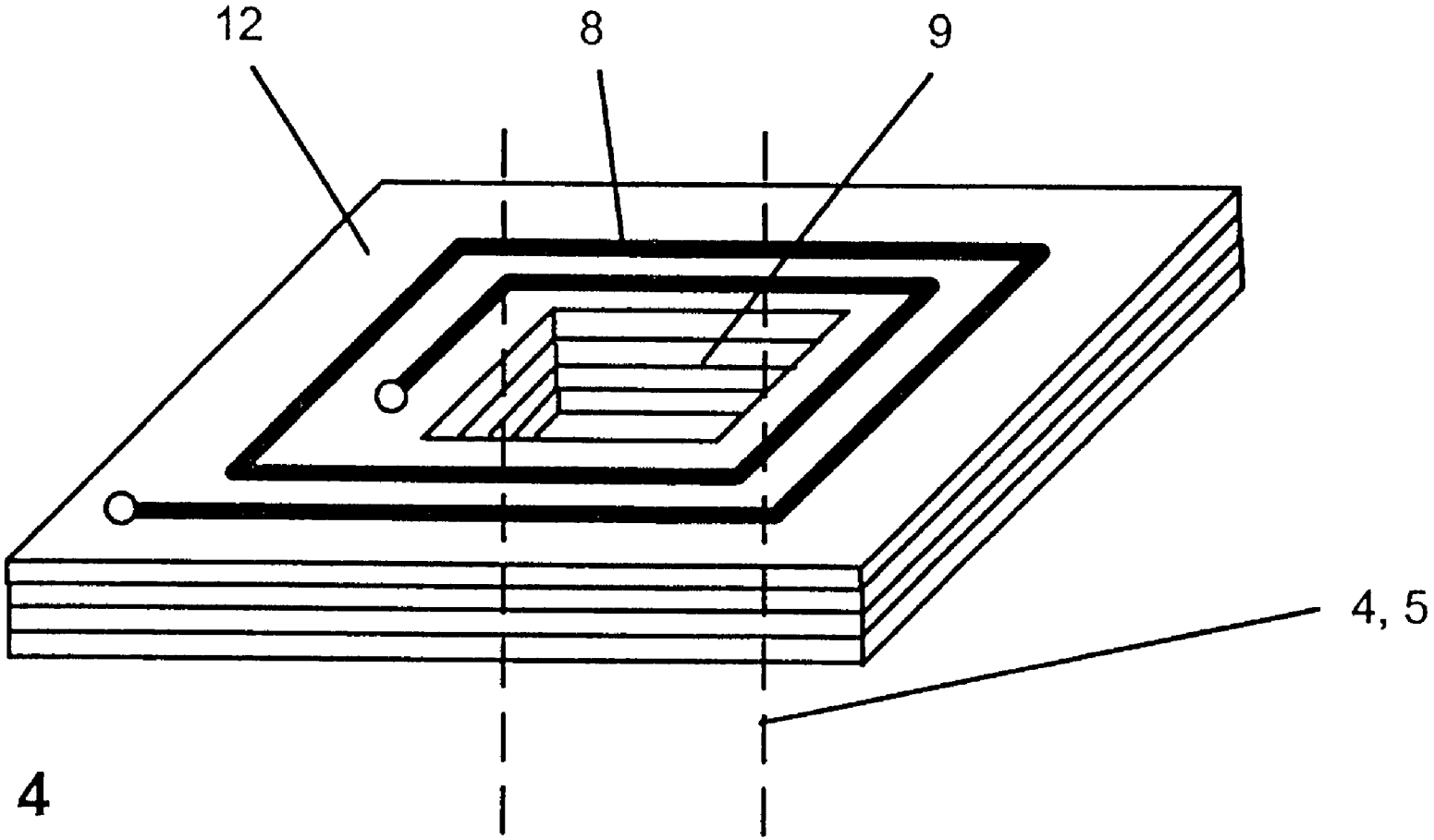
FIG. 4 shows a first embodiment of a multilayer printed circuit board of the signal transformer according to the invention.

FIG. 4 furthermore shows a first embodiment of a multilayer printed circuit board 12. According to the invention, the or each secondary winding 6 of a secondary limb 4, 5 and the control winding 3 of the same secondary limb 4, 5 are in each case described as conductor tracks 8 of such a multilayer printed circuit board 12. In accordance with FIG. 4, the multilayer printed circuit board 12 has an opening 9 for leading through the corresponding secondary limb 4, 5, the conductor tracks 8 of the multilayer printed circuit board 12 extending around the opening 9 in the board propagation direction of the multilayer printed circuit board 12. All the conductor tracks 8 are insulated from one another by means of insulating layers of the multilayer printed circuit board 12. In addition to an advantageous low-inductance realization of the secondary winding 6 and the control winding 3 as conductor tracks 8 of the multilayer printed circuit board 12, it is possible, moreover, to achieve an extremely small structural height of the secondary winding 6 and control winding 3. Furthermore, a multilayer printed circuit board 12 can be produced more simply and more rapidly than individual printed circuit boards, as a result of which, particularly in the case of a relatively large number of secondary windings 6 per secondary limb 4, 5, more rapid and simpler production in conjunction with low production costs is advantageously possible. As a result, the signal transformer according to the invention can also be realized favorably and rapidly. The structural height of the signal transformer according to the invention itself can advantageously be reduced further with the use of the above-described multilayer printed circuit board 12, in particular also with a primary winding 2 realized as a wound conductor. A further advantageous reduction of the structural height of the signal transformer according to the invention is achieved by employing a primary winding printed circuit board in accordance with FIG. 2 in the signal transformer according to the invention in relation to the multilayer printed circuit board 12 in accordance with FIG. 4.

Figure 5:
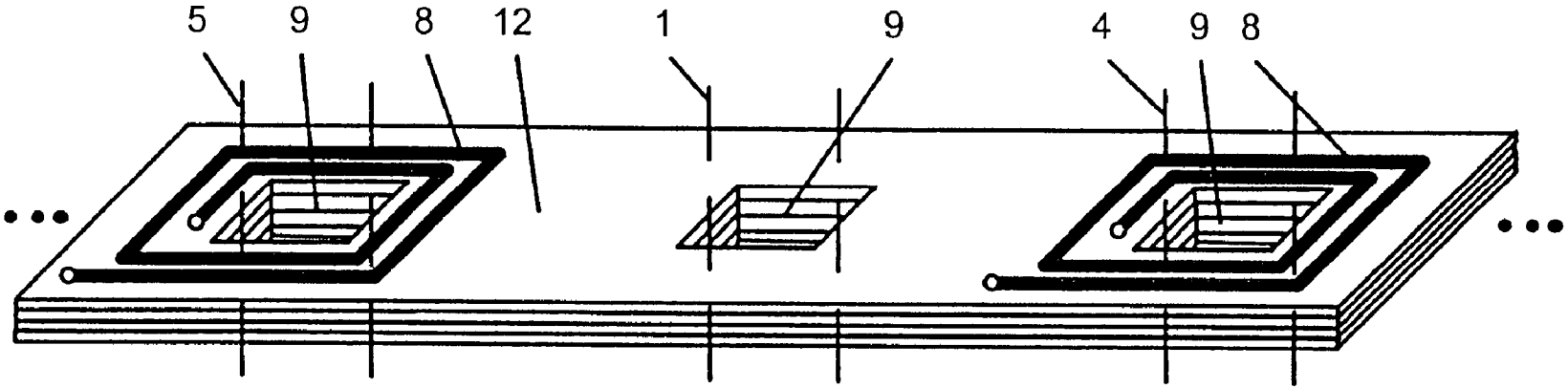
FIG. 5 shows a second embodiment of a multilayer printed circuit board of the signal transformer according to the invention.

In a second embodiment of a multilayer printed circuit board 12 in accordance with FIG. 5, in contrast to the first embodiment of the multilayer printed circuit board 12 according to FIG. 4, the secondary windings 6 of all the secondary limbs 4, 5 and the control windings 3 of all the secondary limbs 4, 5 are in each case designed as conductor tracks 8 of a single multilayer printed circuit board 12. Furthermore, the multilayer printed circuit board 12 in accordance with FIG. 5 has openings 9 for leading through the respective secondary limbs 4, 5 and an opening 9 for leading through the primary limb 1. Furthermore, each conductor track 8 of the multilayer printed circuit board 12 extends around the associated opening 9 in the board propagation direction of the multilayer printed circuit board 12. Furthermore, the conductor tracks 8 are insulated from one another by insulating layers of the multilayer printed circuit board 12. For this second embodiment of the multilayer printed circuit board 12, too, an extremely small structural height of the secondary winding 6 and winding 3 can additionally be achieved as well as the advantageous low-inductance realization of the secondary winding 6 and the control winding 3 as conductor tracks 8 of the multilayer printed circuit board 12. Particularly with an in total high number of secondary windings 6 per signal transformer, a single multilayer printed circuit board 12 in accordance with FIG. 5 can be produced more simply and more rapidly than individual multilayer printed circuit boards 12 for the secondary limbs 4, 5 in accordance with FIG. 4, so that more rapid and simpler production in conjunction with low production costs is advantageously possible. Consequently, the signal transformer according to the invention can also be realized favorably and rapidly. The further advantages with regard to structural height specified in relation to the first embodiment of the multilayer printed circuit board in accordance with FIG. 4 also apply to the second embodiment of the multilayer printed circuit board in accordance with FIG. 5.

Figure 6:
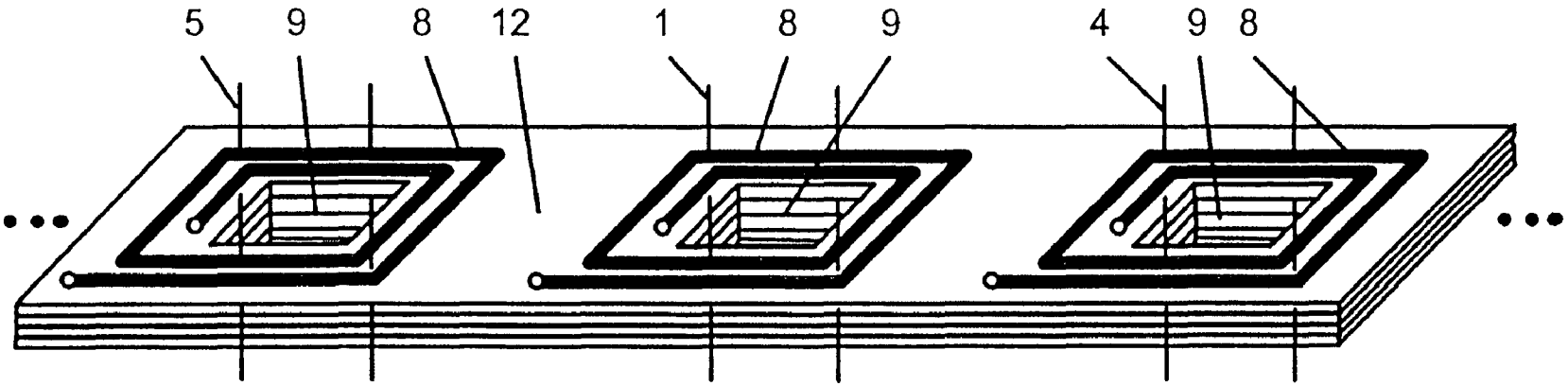
FIG. 6 shows a third embodiment of a multilayer printed circuit board of the signal transformer according to the invention.

In a third embodiment of a multilayer printed circuit board 12 in accordance with FIG. 6, in contrast to the first embodiment of the multilayer printed circuit board 12 according to FIG. 4 and in contrast to the second embodiment of the multilayer printed circuit board 12 according to FIG. 4, the secondary windings 6 of all the second limbs 4, 5 and the control windings 3 of all the secondary limbs 4, 5 and the primary winding 2 of the primary winding limb 1 are in each case designed as conductor tracks 8 of a single multilayer printed circuit board 12. Furthermore, the multilayer printed circuit board 12 in accordance with FIG. 6 has openings 9 for leading through the respective secondary limbs 4, 5 and an opening 9 for leading through the primary limb 1. Moreover, each conductor track 8 of the multilayer printed circuit board 12 extends around the associated opening 9 in the board propagation direction of the multilayer printed circuit board 12. Furthermore, the conductor tracks 8 are insulated from one another by insulating layer of the multilayer printed circuit board 12. For this third embodiment of the multilayer printed circuit board 12, too, a low-inductance realization of the primary winding 2 as a conductor track 8 is additionally achieved as well as the advantageous low-inductance realization of the secondary winding 6 and control winding 3 as conductor tracks 8 of the multilayer printed circuit board 12. Furthermore, the multilayer printed circuit board 12 according to FIG. 6 represents a further reduction of the structural height of the signal transformer according to the invention in comparison with a signal transformer according to the invention with the embodiments of the multilayer printed circuit board 12 in accordance with FIG. 4 and FIG. 5. What is more, a further simplification of the realization and an associated cost reduction of the signal transformer according to the invention can be achieved by means of the multilayer printed circuit board 12 in accordance with FIG. 6 since a separate primary winding 2 in the form of a wound conductor or a primary winding printed circuit board 7 is not necessary.

It goes without saying that the signal transformer according to the invention is not restricted to realizations with the above-described combinations of the embodiments of the primary windings 2, secondary windings 6 and control windings 3, in particular according to FIG. 2 to FIG. 6. An arbitrary combination of the embodiments of the above-described primary windings 2, secondary windings 6 and control windings 3 and the number thereof is accordingly possible.

Overall, the signal transformer according to the invention represents a particularly space-saving, simple, cost-effective and readily maintainable solution which, moreover, has a high degree of availability.

In the invention's method for operating the signal transformer, a main flux $\Phi_H$ is generated in the primary limb 1 by feeding the primary winding signal $S_p$ into the primary winding 2. The main flux $\Phi_H$ of the primary limb 1 is divided into partial fluxes $\Phi_{T1}$, $\Phi_{T2}$, $\Phi_{T3}$, . . . between the secondary limbs 4, 5 on both sides of the primary limb 1, the number of partial fluxes $\Phi_{T1}$, $\Phi_{T2}$, $\Phi_{T3}$, . . . on one side of the primary limb corresponding to the number of secondary limbs 4, 5 on this side. Each partial flux $\Phi_{T1}$, $\Phi_{T2}$, $\Phi_{T3}$, . . . in the associated secondary limb 4, 5 effects a secondary winding signal $S_s$ in the secondary winding or windings 6 of the associated secondary limb 4, 5. According to the invention, the control signal $S_{st}$ is fed into at least one control winding 3 in such a way that a control flux is generated in the associated secondary limb 4, 5. The secondary winding signal $S_s$ present at the associated secondary winding 6 of the corresponding secondary limb 4, 5 is then influenced by the control flux. The influencing of the secondary winding signal $S_s$ is caused by the control flux, which influences the partial flux $\Phi_{T1}$, $\Phi_{T2}$, $\Phi_{T3}$, . . . Of the corresponding secondary limb 4, 5, i.e. reduces, compensates for or amplifies the partial flux $\Phi_{T1}$, $\Phi_{T2}$, $\Phi_{T3}$, . . . of the corresponding secondary limb 4, 5. By way of example, if a control flux is generated which counteracts the corresponding partial flux $\Phi_{T1}$, $\Phi_{T2}$, $\Phi_{T3}$, . . . in such a way that the partial flux $\Phi_{T1}$, $\Phi_{T2}$, $\Phi_{T3}$, . . . is compensated for, then no secondary winding signal $S_s$ is present at the associated secondary winding 6. The secondary winding signal $S_s$ would then be switched off in this example. The possibility of the virtually arbitrary influencing of the corresponding secondary winding signal $S_s$ by the control flux enables the signal transformer to be operated particularly efficiently.

Preferably, in the method according to the invention, the secondary winding signal $S_s$ is switched on or off by the control flux. In this case, the secondary winding signal $S_s$ is switched off in the manner described above. By contrast, the secondary winding signal $S_s$ is switched on for example by virtue of the fact that no control signal $S_{st}$ is applied to the corresponding control winding 3 and, consequently, no control flux which compensates for the corresponding partial flux $\Phi_{T1}$, $\Phi_{T2}$, $\Phi_{T3}$, . . . is generated.

The signal transformer according to the invention is particularly advantageously employed in a driver circuit for at least one drivable power semiconductor switch, in particular for a bipolar transistor having a driving electrode arranged in an insulated manner, turn-off thyristor, such as GTO or IGCT, for example, and/or for a power MOSFET. According to the invention, such a driver circuit has a signal transformer described above. The driver circuit furthermore comprises a signal function generator, the signal transformer according to the invention preferably being connected in between said signal function generator and the at least one drivable power semiconductor switch. By virtue of the fact that at least one secondary winding 6 is in each case provided for the additional secondary limbs 5 and for the first secondary limb 4 of the signal transformer, the primary winding signal $S_p$ fed into the primary winding 1 can be transmitted to all the secondary windings 6. Consequently, a multiplicity of the abovementioned drivable power semiconductor switches, which are advantageously each connected to a secondary winding 6, can be supplied with the drive signals required for driving, which signals are the respective secondary winding signals $S_s$, by just a single signal transformer. Via the respective control windings 3 of the secondary limbs 4, 5, the corresponding secondary winding signals $S_s$ can then be switched on or off by the method according to the invention described above, as a result of which a very simple functionality of the driver stage can be achieved.

If a plurality of drivable power semiconductor switches are to be switched on or off essentially simultaneously, as is customarily required with series circuits of power semiconductor switches, then the embodiment of the signal transformer according to the invention with a number of secondary windings 6 for each secondary limb 4, 5 corresponding to the number of power semiconductor switches to be switched on or off virtually simultaneously is advantageously to be used for a driver circuit. Each of these power semiconductor switches is then connected to one of the secondary windings 6 of the corresponding secondary limb 4, 5. By means of the control signal $S_{st}$ mentioned in the method according to the invention described above, the secondary winding signals $S_s$ can then advantageously be switched on or off for such a secondary limb 4, 5 in a targeted manner and virtually simultaneously in a manner required for this case.

Overall, the use of the signal transformer according to the invention in a driver circuit for at least one drivable power semiconductor switch makes it possible to realize a particularly space-saving, simple, cost-effective and readily maintainable driver circuit which, moreover, encompasses a high degree of availability.

| List of reference symbols | |
|---|---|
| 1 | Primary limb |
| 2 | Primary winding |
| 3 | Control winding |
| 4 | First secondary limb |
| 5 | Additional secondary limb |
| 6 | Secondary winding |
| 7 | Primary winding printed circuit board |
| 8 | Conductor track |
| 9 | Opening |
| 10 | Secondary winding printed circuit board |

-continued

| List of reference symbols | |
|---|---|
| 11 | Control winding printed circuit board |
| 12 | Multilayer printed circuit board |
| 13 | Signal transformer core |
| 14 | Yoke |

The invention claimed is:

1. A signal transformer having a primary limb and a first secondary limb, a primary winding at least partly enclosing the primary limb and a secondary winding at least partly enclosing the first secondary limb and the primary limb being connected to the first secondary limb, wherein 2n+1 additional secondary limbs are provided, where n=0, 1, 2, 3, . . . , and the additional secondary limbs are connected to the primary limb and the first secondary limb, wherein at least one secondary winding is in each case provided for the additional secondary limbs and for the first secondary limb, the secondary winding at least partly enclosing the respective secondary limb, and wherein a respective control winding at least partly encloses a respective secondary limb.

2. The signal transformer as claimed in claim 1, wherein there is the same number of secondary limbs on both sides of the primary limb.

3. The signal transformer as claimed in claim 2, wherein the distance between respectively adjacent secondary limbs and the distance between the primary limb and a respective secondary limb adjacent to the primary limb are the same.

4. The signal transformer as claimed in claim 1, wherein the primary winding is designed as a conductor track of a primary winding printed circuit board.

5. The signal transformer as claimed in claim 4, wherein the conductor track of the primary winding printed circuit board is surrounded by an insulating layer.

6. The signal transformer as claimed in claim 4, wherein the primary winding printed circuit board has an opening for leading through the primary limb.

7. The signal transformer as claimed in claim 6, wherein the conductor track of the primary winding printed circuit board extends around the opening in the board propagation direction of the primary winding printed circuit board.

8. The signal transformer as claimed in claim 1, wherein the or each secondary winding of a secondary limb is in each case designed as a conductor track of a respective secondary winding printed circuit board, and wherein the control winding of a secondary limb is designed as a conductor track of a control winding printed circuit board.

9. The signal transformer as claimed in claim 8, wherein the conductor track of the secondary winding printed circuit board and the conductor track of the control winding printed circuit board are surrounded by an insulating layer.

10. The signal transformer as claimed in claim 8, wherein the secondary winding printed circuit board and the control winding printed circuit board have an opening for leading through the respective secondary limb.

11. The signal transformer as claimed in claim 10, wherein the conductor track of the secondary winding printed circuit board extends around the opening in the board propagation direction of the secondary winding printed circuit board, and wherein the conductor track of the control winding printed circuit board extends around the opening in the board propagation direction of the control winding printed circuit board.

12. The signal transformer as claimed in claim 1, wherein the or each secondary winding of a secondary limb and the control winding of the same secondary limb are in each case designed as conductor tracks of a multilayer printed circuit board.

13. The signal transformer as claimed in claim 12, wherein the multilayer printed circuit board has an opening for leading through the secondary limb.

14. The signal transformer as claimed in claim 13, wherein the conductor tracks of the multilayer printed circuit board extend around the opening in the board propagation direction of the multilayer printed circuit board.

15. The signal transformer as claimed in claim 1, wherein the secondary windings of the secondary limbs and the control windings of the secondary limbs are in each case designed as conductor tracks of a multilayer printed circuit board.

16. The signal transformer as claimed in claim 1, wherein the secondary windings of the secondary limbs and the control windings of the secondary limbs and the primary winding of the primary winding limb are in each case designed as conductor tracks of a multilayer printed circuit board.

17. The signal transformer as claimed in claim 15 wherein the multilayer printed circuit board has openings for leading through the respective secondary limbs and an opening for leading through the primary limb.

18. The signal transformer as claimed in claim 17, wherein each conductor track of the multilayer printed circuit board extends around the associated opening in the board propagation direction of the multilayer printed circuit board.

19. The signal transformer as claimed in claim 12, wherein the conductor tracks are insulated from one another by insulating layers of the multilayer printed circuit board.

20. A method for operating a signal transformer as claimed in claim 1, in which a main flux is generated in the primary limb by feeding a primary winding signal into the primary winding, wherein a control signal is fed into at least one control winding in such a way that a control flux is generated in the associated secondary limb, and wherein a secondary winding signal present at the associated secondary winding is influenced by means of the control flux.

21. The method as claimed in claim 20, wherein the secondary winding signal is switched on or off by the control flux.

22. A signal transformer as claimed in claim 1, wherein the signal transformer is comprised in a driver circuit for at least one drivable power semiconductor switch.

23. The signal transformer as claimed in claim 22, wherein the signal transformer is connected in between a signal function generator and at least one drivable power semiconductor switch.

* * * * *